US006439566B1

(12) United States Patent
van der Werff

(10) Patent No.: US 6,439,566 B1
(45) **Date of Patent: *Aug. 27, 2002**

(54) APPARATUS FOR SEPARATING SHEETS FROM A STACK

(75) Inventor: Jeichienus Adriaan van der Werff, Montfoort (NL)

(73) Assignee: Hadewe B.V., Drachten (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/829,514

(22) Filed: Mar. 28, 1997

(30) Foreign Application Priority Data

Mar. 29, 1996 (NL) ..... 1002743

(51) Int. Cl.[7] ..... B65H 3/04
(52) U.S. Cl. ..... 271/14; 271/101; 414/797.6
(58) Field of Search ..... 271/12, 14, 100, 271/101, 104, 106, 35, 102, 107; 414/797.6, 797.7, 797.8; 211/105, 35

(56) References Cited

U.S. PATENT DOCUMENTS 4,127,262 A 11/1978 Eberle et al.
4,132,398 A * 1/1979 Erdmann et al. ..... 271/101 X
4,331,327 A * 5/1982 Felix
5,106,070 A * 4/1992 Reist ..... 271/12
5,441,249 A * 8/1995 Todaro et al.
5,556,254 A 9/1996 Darcy et al.

FOREIGN PATENT DOCUMENTS

| | | |
|---|---|---|
| CH | 637 087 | 3/1979 |
| EP | 0 064 778 A1 | 11/1982 |
| EP | 0 417 503 A1 | 3/1991 |
| EP | 0 752 383 A2 | 1/1997 |
| GB | 829 518 | 3/1960 |

* cited by examiner

*Primary Examiner*—Kenneth E. Peterson
(74) *Attorney, Agent, or Firm*—Burns, Doane, Swecker & Mathis, L.L.P.

(57) ABSTRACT

Sheet feeder comprising a holder with a guide for guiding a stack of sheets and with an abutment structure which defines an abutment plane for keeping a stack of sheets in a position with an outer sheet positioned against the abutment plane. The abutment structure is provided with a slit for allowing a sheet or a set of sheets to pass therethrough, which slit is movable relative to the guide along the abutment plane, with a directional component transverse to the slit for peeling outer sheets abutting against the abutment structure off a stack of sheets in the holder. Further, a method for separating sheets from a stack is described. Because sheets are peeled off a stack without sliding relative to each other, they can be separated without hindrance due to friction between them.

8 Claims, 9 Drawing Sheets

APPARATUS FOR SEPARATING SHEETS FROM A STACK

FIELD OF THE INVENTION

This invention relates to an apparatus for separating sheets from a stack, and to a method for separating sheets from a stack.

BACKGROUND OF THE INVENTION

Such an apparatus and such a method are known from practice and are used in many variants in devices that process sheets of paper, such a photocopiers, printers and inserter systems. In such known devices, the separation is carried out by sliding an outer sheet or an outer set of sheets off the stack and arresting, through separation means, any further sheets that move along with the outer sheet or the set of outer sheets, in order to take only one sheet or one set of sheets from the stack. A problem with such methods is that friction between sheets to be separated must be overcome by friction forces that are exerted on those sheets by transport and separation surfaces. This imposes stringent requirements on the friction coefficient between the transport and separation surfaces on the one hand and the sheets on the other, in particular if it should be possible to process a relatively large variety of kinds of paper or if unfavorable conditions, such as a high relative degree of humidity or a low temperature, prevail. Especially in so-called bottom feed separation systems, in addition, a great frictional force occurs between the sheets to be separated in that the rest of the stack bearing on the bottom sheet or the bottom set of sheets exerts a great normal force on the sheets to be separated. According as the stack above the sheets to be separated has a greater height, this problem occurs to a greater extent.

In order that, at a given normal force, more friction can be generated between the transport and separation surfaces on the one hand and the sheets on the other than the mutual friction between sheets to be separated, relatively soft kinds of rubber are utilized for the transport and separation surfaces. However, such kinds of rubber have little wear-resistance and exhibit a greatly decreasing roughness upon ageing. Also, fouling of the transport and separation surfaces and the action thereon of inks provided on processed papers have an adverse effect on the roughness of the transport and separation surfaces. Generally, with such separation systems the degree of reliability desired by the users is not achieved in practice then.

In addition, for large-scale applications—such as the processing of sheets in printing offices—it is known to separate sheets by taking them off a stack using suction cups communicating with a partial vacuum. Generally, such systems have the inherent drawback that they are complicated in construction and occupy much space. Further, for separating sets of sheets, special measures have to be taken to ensure that the mutual connection between the sheets of a set remains intact during separation and feeding of the sets. Another drawback of such systems is that they are not suitable for applications where the side of the stack where the sheets are taken off abuts against an abutment structure. This is the case, for instance, with so-called bottom feed systems.

SUMMARY OF THE INVENTION

The object of the invention is to enable the separation of sheets or sets of sheets from a stack with a greater reliability than has been attainable heretofore with the known separation system working on the basis of friction, using equipment that is simpler and more compact than that in which sheets are taken off a stack using suction cups.

This object is achieved in accordance with the invention by providing an apparatus for separating an outer sheet or an outer set of sheets from a stack, comprising a holder with at least one guide for guiding a stack of sheets and with an abutment structure which defines an abutment plane for keeping a stack of sheets in the holder in a position with an outer sheet positioned against the abutment plane, wherein the abutment structure is provided with a slit for allowing a sheet or a set of sheets to pass therethrough, which slit is movable relative to the at least one guide along the abutment plane along a path with a directional component transverse to the slit for at least partly peeling an outer sheet or an outer set of sheets abutting against the abutment structure from a stack of sheets in the holder. The invention further provides a method for separating an outer sheet or an outer set of sheets from a stack, which sheet or set of sheets abuts against an abutment plane defined by an abutment structure, comprising bringing opposite to or into a slit in the abutment structure a corner or edge portion of the outer sheet or of the outer set of sheets and displacing the slit along the abutment plane along a path with a directional component transverse to the longitudinal direction of the slit, whereby at least a portion of the outer sheet or the outer set of sheets passes through the slit.

Owing to the abutment structure being provided with a slit movable relative to the stack in the holder along the abutment plane, with a directional component transverse to the slit, an outer sheet or an outer set of sheets abutting against the abutment structure and of which a corner or edge portion is located opposite to or in the slit can be peeled off the stack without that sheet or that set of sheets needing to slid relative to the stack while being peeled off the stack. During the displacement of the slit at least a portion of the outer sheet or the outer set of sheets passes through the slit, basically in the manner of a slice of cheese passing through a cheese slicer while being sliced off. For that matter, the stack can abut against the abutment plane from above, from the side as well as from below.

Because the sheets, while being separated from the rest of the stack, do not slide relative to other sheets of the stack, problems resulting from friction between the sheets to be separated are avoided.

The displacement of the slit in the abutment structure can be realized in a simple manner and displacements of the sheets being separated are simply controlled, during the passage through the slit, by the slit which at the same time forms a guide for the sheets. Thus the apparatus and the method according to the invention can be realized in a simple manner and in a limited space.

Further objects, advantages and embodiments of the invention appear from the claims and the following description on the basis of exemplary embodiments with reference to the drawings.

DETAILED DESCRIPTION

The invention will first be further explained on the basis of the exemplary embodiment of an apparatus according to the invention which is preferred most at present, shown in FIGS. 1–5. Then some particular alternative embodiments are described.

Figure 1:
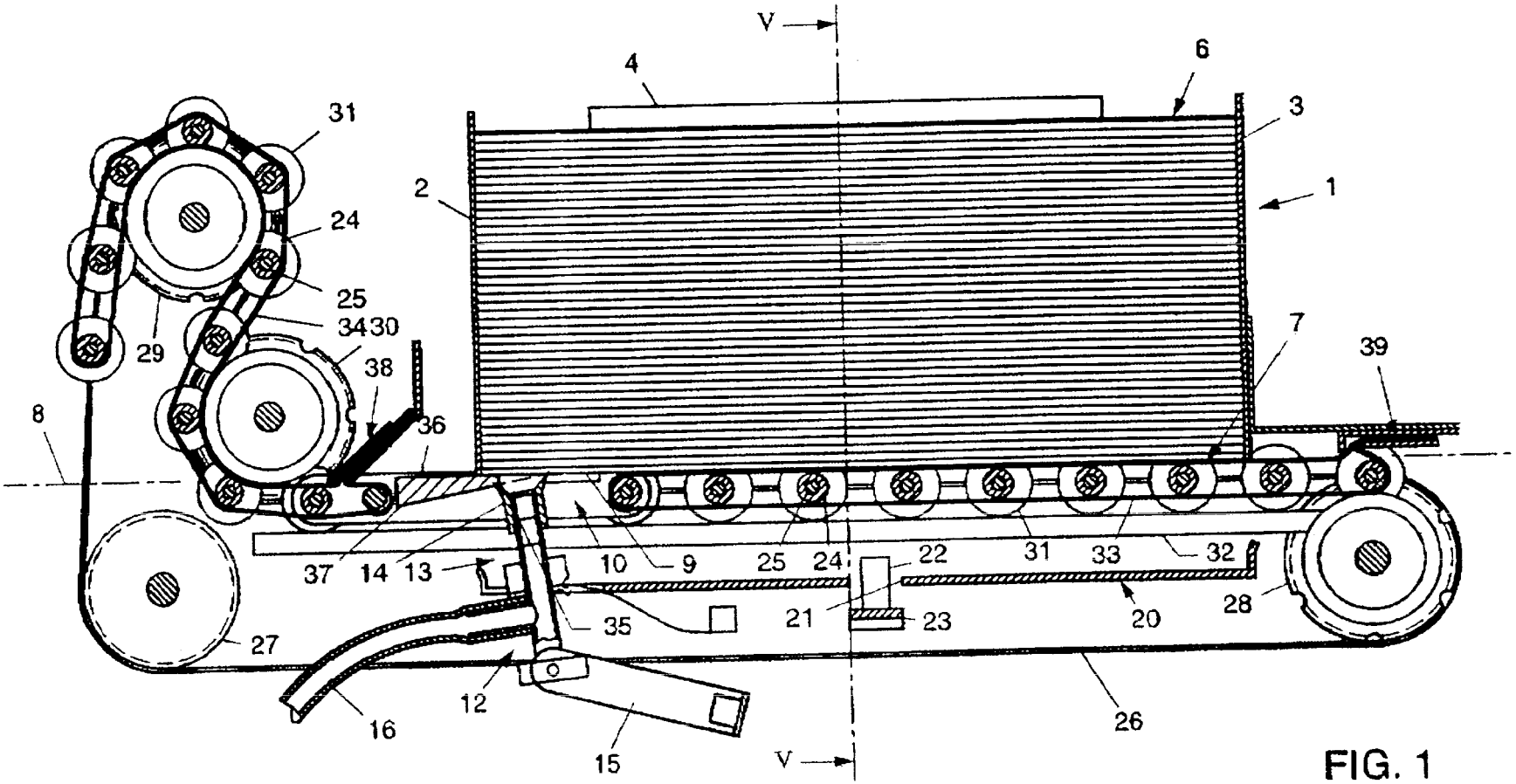
FIGS. 1–4 are side elevations in cross section taken on line I—I in FIG. 5 of an apparatus according to a first exemplary embodiment of the invention in successive operative stages.
Figure 3:
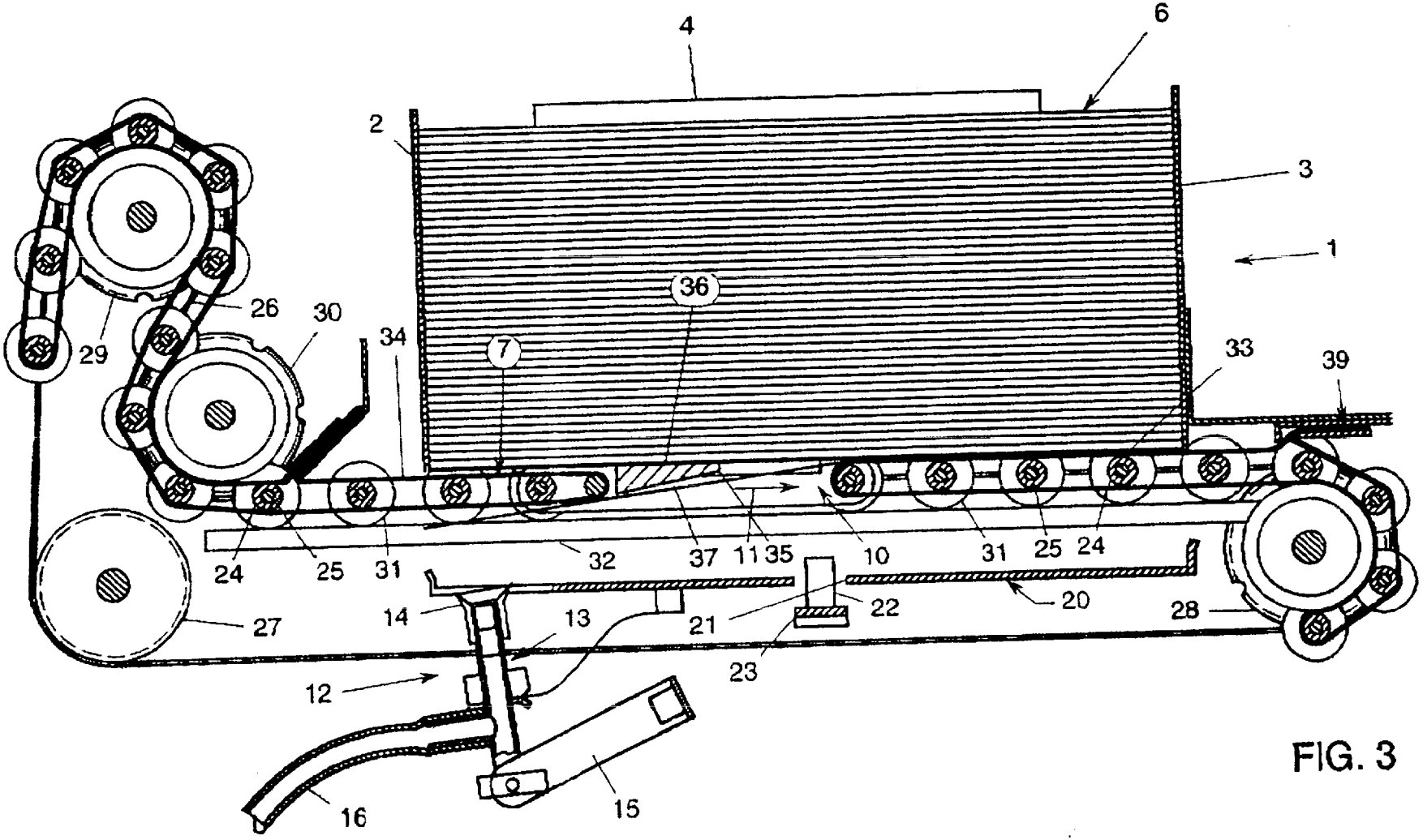
Figure 4:
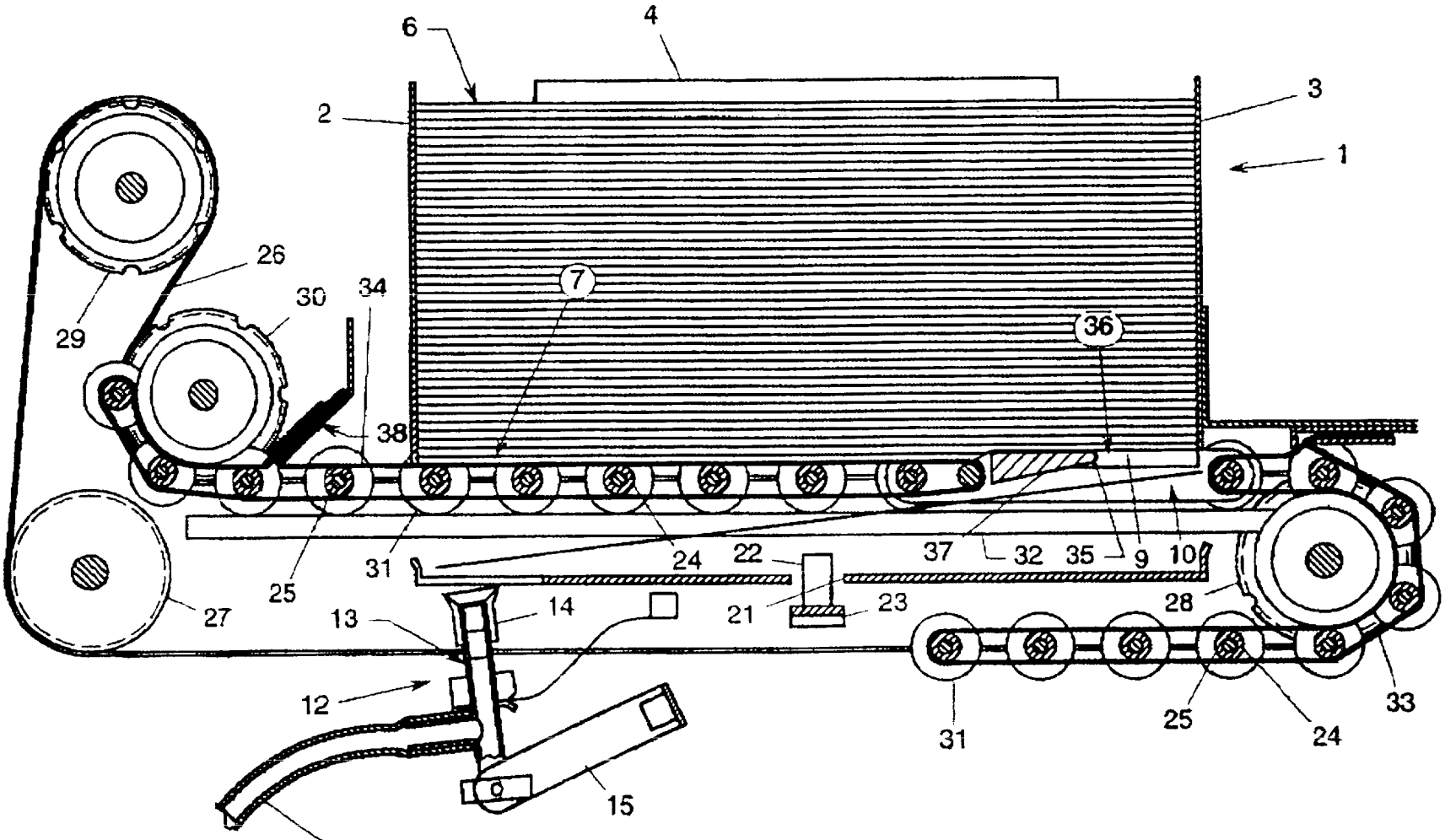
Figure 5:
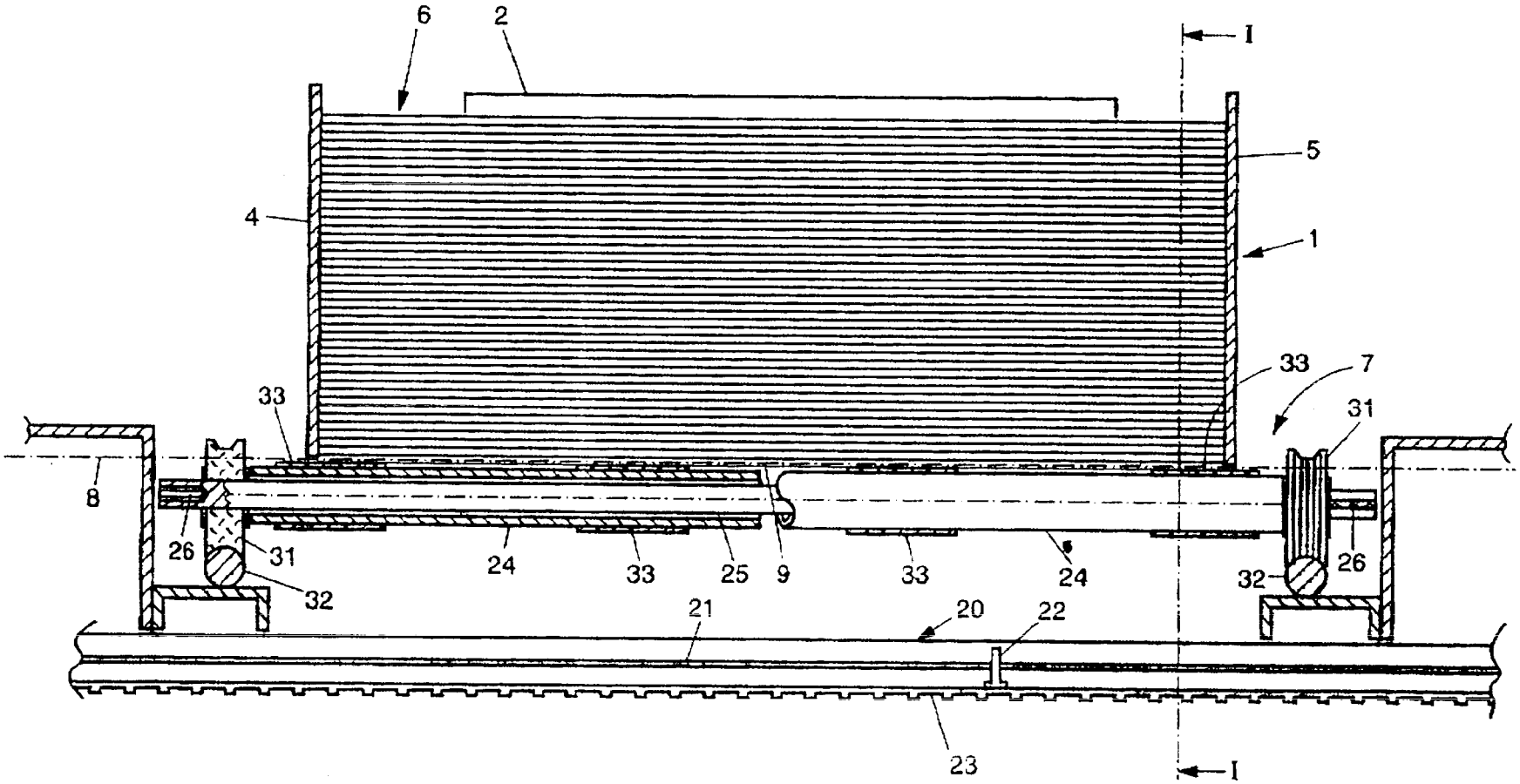
FIG. 5 is a cutaway side elevation in cross section taken on line V—V in FIG. 1.

The apparatus shown in FIGS. 1–5 comprises a holder 1 with guides 2, 3, 4, 5 for holding a stack of sheets 6 in position and with an abutment structure 7 which defines an abutment plane 8 (see FIG. 1 and FIG. 5). The stack 6 in the holder 1 is held in position against the abutment structure via an outer sheet 9 of the stack, inasmuch as the abutment structure 7 forms the bottom of the holder 1 on which the stack rests. The abutment structure 7 is provided with a slit 10 for allowing a sheet 9 to pass. The slit 10 is movable relative to the guides 2, 3, 4, 5, which keep the stack 6 in position, along the abutment plane 8 in a direction transverse to the slit, denoted with an arrow 11 in FIG. 3. Further, the slit 10 is movable in the opposite direction in order to return it to its starting position shown in FIGS. 1 and 2. In comparison with the construction described hereinafter, where the slits are movable along a circular path, the embodiment with a reciprocable slit provides the advantage that a more compact, simpler, and better accessible construction can be obtained.

Arranged in the area of the position of the starting position of the slit 10 is a picker 12 for moving an edge portion of an outer sheet 9 or of an outer set of sheets of a stack in the holder 1, from a stack 6 in the holder 1 to a position where the outer sheet or outer set of sheets projects into the slit 10. The picker 12 is arranged on a side of the abutment plane 8 remote from the holder 1 and is positioned and arranged for drawing a corner or edge portion of an outer sheet 9 or of an outer set of sheets of a stack in the holder 1 into the slit 10 disposed in a certain position.

Figure 2:
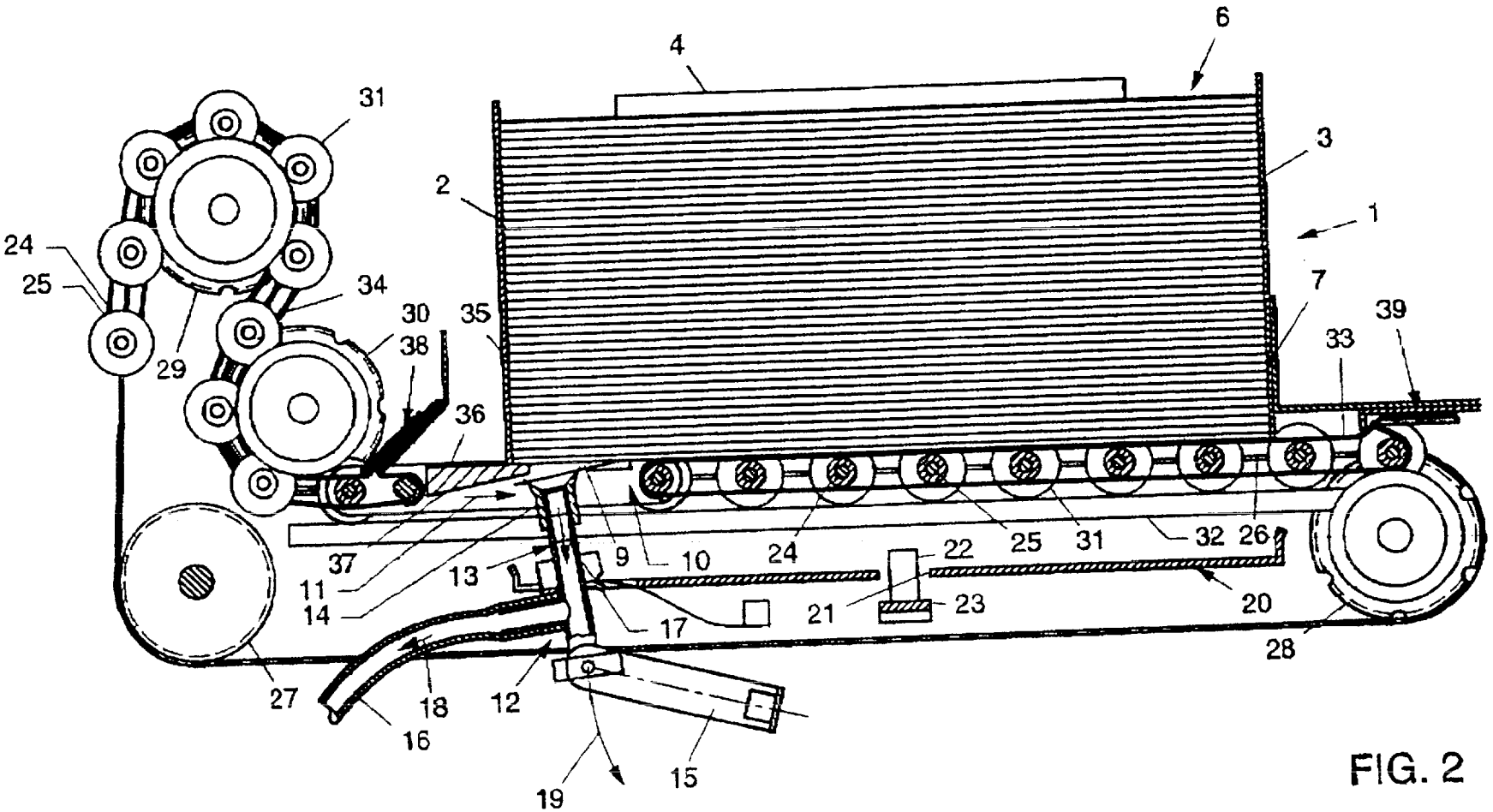

The picker 12 is made up of a nozzle 13 provided with a suction cup 14 forming the picker head for pulling outer sheets or sets of sheets into the slit. The nozzle 13 is suspended by means of a pivotable arm 15, in such a manner that it is reciprocable between a first position remote from the abutment structure 7 (FIGS. 3 and 4) and a second position projecting into the slit 10 (FIGS. 1 and 2). On its side remote from the suction cup 14, the nozzle 13 is connected to a tube 16 which in turn communicates with a vacuum source, for extracting air via the nozzle 13.

In operation, the condition shown in FIG. 1 forms a starting situation, wherein the slit 10 is in a first, extreme position and the nozzle 13 is in a position projecting into the slit 10. In that initial situation the stack 6 bears on the abutment structure 7, with the bottom sheet 9 being supported on opposite sides of the slit 10 by surfaces of the abutment structure 7 facing the inside of the holder 1.

Owing to air being drawn in via the nozzle 13 and the tube 16, as indicated in FIG. 2 by arrows 17, 18, the outer sheet 9 of the stack 6 is pulled away on one side of the slit 10 between the abutment structure 7 and the rest of the stack 6, as appears from FIG. 2. The arm 15 is thereafter pivoted in the direction indicated with an arrow 19, so that the nozzle 13 moves away from the stack 6, and the edge portion of the outer sheet 9 sucked against the nozzle 13 is brought into the position projecting into the slit 10, shown in FIG. 2.

Because the edge portion of an outer sheet or an outer set of sheets is brought into the slit 10 by pulling it towards the slit 10 using an element adhering to that edge portion, only the outer sheet or the outer set of sheets is subject to a pull, so that it is ensured in a simple manner that only the outer sheet or the outer set of sheets is brought into the slit. Owing to the picker head used for pulling the outer sheet or the outer set of sheets being designed as a suction cup 14, in which a reduced pressure prevails, the adhesive action can be simply set at a suitable level for the application contemplated.

It is also possible, however, to use, instead of a reduced pressure, an adhesive surface with a sticky material. This adhesive surface can, for instance, be detached from the sheet in questing by peeling. As an adhesive surface, for instance a sticky layer of adhesive tape passed over a picker roller, with its sticky side facing outwards, can be used.

After the edge portion of a sheet 9 has been brought into the slit 10, the suction of air via the nozzle 13 is briefly interrupted and the arm 15 is pivoted further, so that the nozzle 13 is moved to the position remote from the abutment plane 8, shown in FIG. 3, and the sheet 9 is released by the nozzle 13.

The slit 10 is moved along the abutment plane 8 in a direction transverse to the longitudinal direction of the slit 10, as is indicated by the arrows 11 (see FIGS. 2 and 3). In the process, the outer sheet 9 passes through the slit 10 until the position represented in FIG. 4 is reached, where the former outer sheet is entirely clear of the stack 6. A next sheet 9 then forms the outer sheet of the stack 6.

From the condition represented in FIG. 4, the slit 10 and the arm 15 are moved back again into the positions represented in FIG. 1, in such a manner, of course, that the nozzle 13 does not butt against the returning abutment structure 7.

In the method of which successive stages are represented in FIGS. 1–4, a sheet is peeled off the underside of the stack 6, without the sheet needing to be moved relative to other sheets during its passage through the slit 10. As a result, sheets or set of sheets can be separated from the stack 6 without experiencing hindrance due to friction between sheets to be separated from each other. In the separation of sets of sheets, such as booklets or set of sheets stapled together, each set is preferably brought into the slit 10 with a bound edge or corner in leading position, so that each time exactly one set can be brought into the slit 10 in a simple manner and with great reliability.

What is also avoided due to the slit 10 moving between the sheet to be separated and the rest of the stack is that a next sheet sticks to the sheet to be separated, for instance through static electricity or because air does not flow fast enough between the sheets to be separated. Further, the sheet to be separated is guided by the slit 10 during separation, so that the position and the orientation of the sheet to be separated is always controlled within narrow limits and a controlled transfer to downstream transport means is simply realizable.

During the passage of the outer sheet 9 through the slit 10, this sheet does not slide along a next sheet of the stack 6. As a result, the separation of the outer sheet—or the separation of an outer set of sheets if sets of sheets are being separated—is not impeded by friction between the outer sheet and the rest of the stack. Optionally, each time when only a relatively small portion of the outer sheet is still disposed between the abutment structure 7 and the rest of the stack 6, the sheet can be pulled from between the abutment structure 7 and the rest of the stack 6, so that the length of the path over which the slit is to be displaced can be limited. For pulling away the partly separated sheets, which, it is true, necessitates overcoming a relatively small friction between the sheets to be separated, for instance a set of transport rollers can be used.

For discharging separated and dispensed sheets, a transport track is arranged under the holder 1. This transport track is formed by a guide chute 20 provided with a slot 21, through which reach transport fingers 22. The transport fingers 22 project from a toothed belt 23 running under the chute 20, through the slot 21, and can advance through this chute 20 separated sheets and sets of sheets which have fallen into the chute 20.

The abutment structure 7 comprises rollers, of which, for the sake of clarity, only a few have been indicated with a reference numeral 24, which rollers 24 are rotatably suspended for rolling along the path of movement of the slit 10 along an outer sheet 9 of the stack 6 in the holder 1. By virtue of these rollers 24, the resistance experienced by the abutment structure 7 during the displacement thereof along the stack 6 disposed against it, is very slight. A particular advantage of this slight resistance is that a very slight frictional force is exerted on the outer sheet 9 of the stack 6, so that the danger of dislodgement or upsetting of the sheet 9 abutting against the abutment structure 7 is limited. This danger is especially great when the number of sheets in the stack 6 has run down to one or a few sheets, so that the force with which the outer sheet 9 is pressed flat against the abutment structure is relatively small, and if very thin or at least flexible sheets are being processed.

The rollers 24 are held at a fixed mutual distance in that they are mounted on pins 25 attached with a constant mutual spacing to circulating pulling elements in the form of belts 26.

These belts 26 pass over return rollers 27, 28. In order to prevent the path along which the rollers 24 are movable on the side of the return rollers 27, 28 remote from the holder 1 intersecting the picker 12, two additional divert rollers 29, 30 are arranged between the holder 1 and the return roller 27 located proximal to the picker 12. These divert rollers 29, 30 increase the total length of the circulating belts 26 between the holder 1 and the picker 12 without this entailing a substantial enlargement of the area occupied by the apparatus.

For supporting the pins 25 in the area where the stack 6 abuts against the abutment structure 7 and for providing a low-friction movability of the abutment structure 7 with the slit 10, the pins 25 are bearing-mounted in wheels 31 adapted to ride over rails 32. These rails 32 extend on opposite sides under the area where the stack 6 abuts against the abutment structure 7.

For obtaining a uniform support of the stack and in order to avoid edge portions of outer sheets curling and ending up between the rollers 24, the apparatus according to FIGS. 1–5 is provided with flexible pulling elements 33, 34 each extending on one side of the slit 10 over circumferential portions proximal to the abutment plane 8 of a number of the rollers 24, and are designed as belts. Optionally, a single belt can suffice, which then preferably has a width at least covering a large part of the width of the abutment structure 7. However, the pulling elements can also be designed as cords.

In addition to a uniform support of the rollers, the flexible pulling elements provide the advantage that fewer rollers can suffice. This is of importance in particular for designs where the abutment structure has a large extension in a direction transverse to the slit.

The belts 33, 34 each extend from an anchorage 38 and 39, respectively, operatively fixed with respect to the guides 2, 3, 4, 5 and each located on the same side of the path of the rollers 24 as the holder 1. In the apparatus according to the present example, this path is defined by the paths of the circulating belts 26 to which the pins 25 bearing the rollers 24 are attached with mutual interspaces. These measures prevent portions of the belts 33, 34 that are operatively in contact with the stack 6 from shifting relative to the stack 6, which might lead to documents getting damaged or clamped between the guides 2, 3, 4, 5 and the abutment structure 7.

The portions of the belts 33, 34 extending through the slit 10 away from the holder 1 could be guided in many directions. In order to obtain a compact and simple construction, the belts 33, 34 are designed as loops running along the rollers 24 on a side remote from the abutment plane 8 to the anchorages 38, 39 operatively fixed with respect to the guides 2, 3, 4, 5. In the apparatus shown, this is realized in a constructionally simple manner in that the belts 33, 34 pass along all rollers 24 on the relevant side of the slit 10, so that the extreme rollers 24 located remote from the slit 10 at the same time constitute return rollers for the belts 33, 34.

The apparatus according to the example shown in FIGS. 1–5 further comprises a lead-in edge 35 along one side of the slit 10. This lead-in edge is considerably narrower than the diameter of the rollers 24 and connects to a support surface 36 and a guide surface 37 which diverge away from the lead-in edge 35. By virtue of this relatively narrow lead-in edge 35, an outer sheet 9 only needs to be bent away from the rest of the stack 6 over a very minor distance in order to make it possible to introduce to the portion of the abutment structure 7 that follows the slit 10 between that sheet 9 and the rest of the stack 6. By virtue of the guide surface 37 being contiguous to the lead-in edge 35 and gradually diverging from the abutment plane 8, it is moreover necessary only to bend a sheet or a set of sheets passing through the slit to a slight extent. As a result, it is also possible to process without any problems relatively bending-stiff kinds of paper and other materials as well as relatively thick sets of sheets, such as books of a thickness such as that of, for instance, an average annual report (4–5 mm and more).

Figure 6:
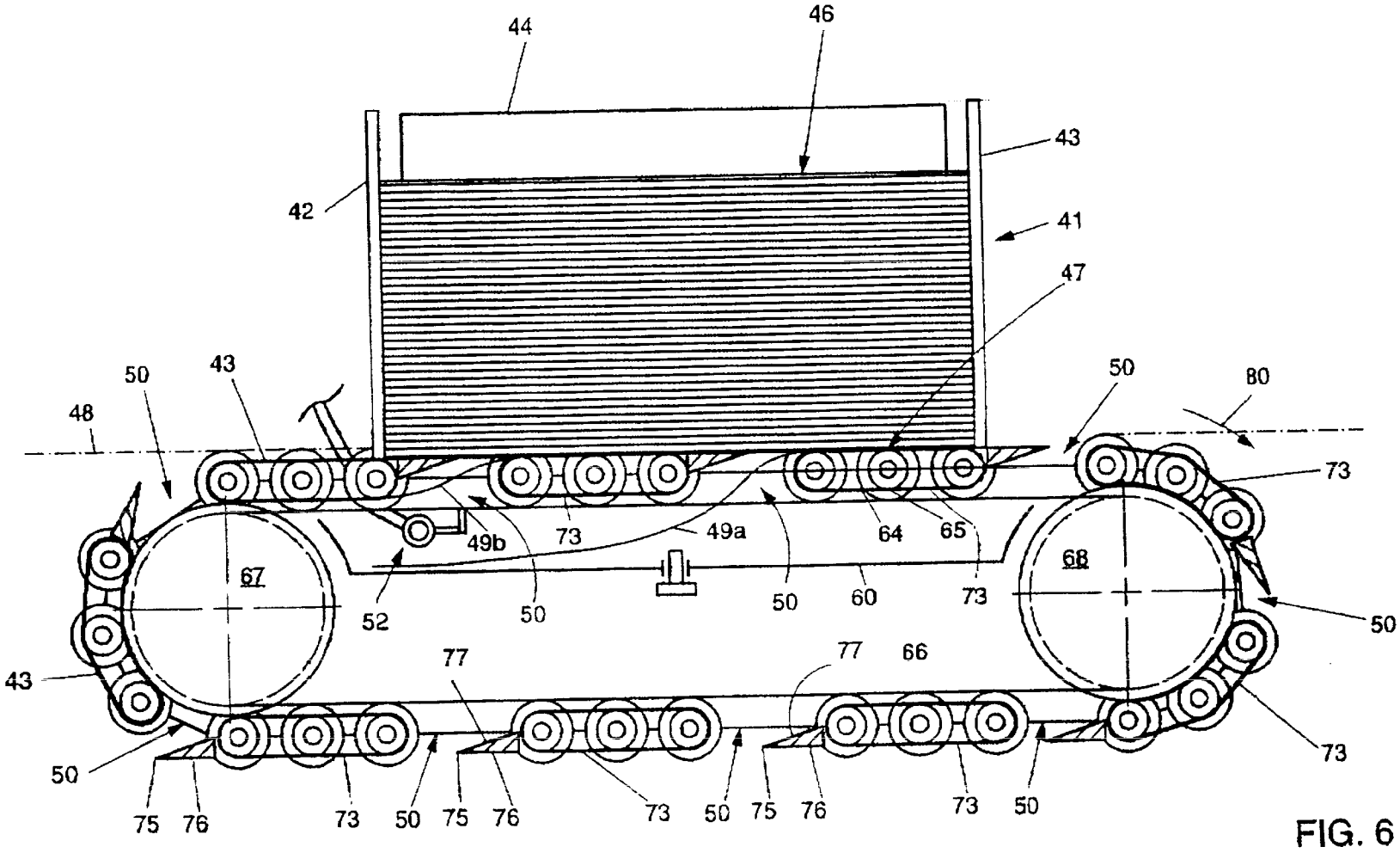
FIG. 6 is a cutaway side elevation of an apparatus according to a second exemplary embodiment of the invention.

The apparatus according to the exemplary embodiment shown in FIG. 6 likewise comprises a holder 41 with guides 42, 43, 44 and an abutment structure 47. In the apparatus according to this example, there likewise extends under the holder 41 a transport track 60 for discharging separated and dispensed sheets. Further, the belts 66 on which the pins 65 of rollers 64 adapted to roll along the abutment plane 48 are mounted, likewise pass along an endless path over return rollers 67, 68. Further, at each slit 50 a lead-in element with a lead-in edge 75 and support and guide surfaces 76, 77 diverging from the lead-in edge are arranged.

Unlike in the above-discussed example, the abutment structure 47 is provided with several slits 50 which are so arranged that several slits 50 are simultaneously located in the area of the abutment structure 7 between the guides 42, 43. As a result, the abutment structure 47 is suitable for simultaneously peeling several sheets 49*a*, 49*b* off the stack 46, so that at a given displacement speed of the slits 50 a greater number of sheets 49 or sets of sheets can be separated per unit time than if one sheet at a time is separated.

Further, the abutment structure 47 is so constructed that the slits 50 in operation circulate in one circulation sense and thus are always passed along the stack 46 in the same direction. That the slits 50 pass along the stack 46 exclusively in a single direction (indicated by an arrow 80) also promotes the number of sheets or sets of sheets that can be separated per unit time, because no time is lost returning the slit 50. Moreover, for driving the continuous, circulating movement of the abutment structure 47 and the slits 50, a simple drive can suffice.

The abutment structure 47 is further equipped with a number of belts 73 each circulating around three of the rollers 64. During the displacement of the slits 50, these belts roll along the outer sheet 49 of the stack 46, so that the stack is sufficiently supported, while yet only slight frictional forces are exerted on the stack 46. Optionally, guides can be provided laterally of the stack, which ensure that the belts 73 also circulate if the holder 41 contains only one or a limited number of sheets, as a result of which the pressure force of the sheets would be too slight to cause the passing belts to circulate. Optionally, instead of the circulating belts, circulating roller tracks without belts can be used.

In the apparatus according to this example the picker 52 is pivotable about an axis parallel to the plane of the paper and located at the height of the abutment plane 48 just behind the holder 1.

Figure 7:
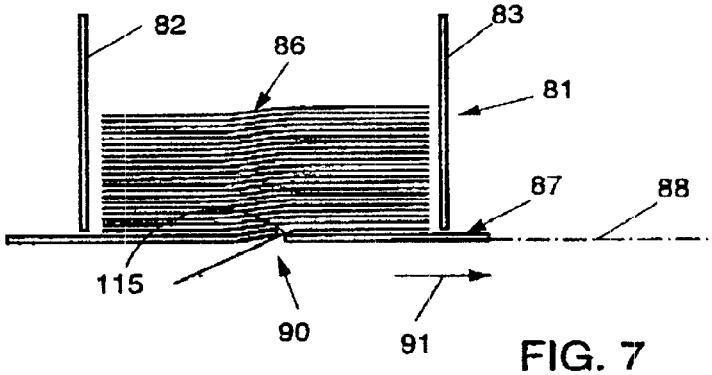
FIG. 7 is a diagrammatic cutaway side elevation of an apparatus according to a third exemplary embodiment of the invention.

The apparatus shown diagrammatically in FIG. 7 is made up of a holder 81 with guides 82, 83 for a stack 86 and an abutment structure 87 provided with a slit 90 which is movable relative to the guides 82, 83 in a direction indicated by an arrow 91. The abutment structure 87 is designed as a very smooth surface, so that the frictional force operatively exerted on the bottom sheet remains limited.

An edge 115 of the slit 90 is designed as a narrow lead-in edge 115 which is staggered with respect to the abutment plane 88 and the opposite edge of the slit 90. As a result, when passing through the slit, a sheet need only bend very little, and by flanging a single plate along the edge of the slit 90, basically in the manner of a cutting edge of a cheese slicer, in a very simple manner a guide surface can be obtained which extends at a slant with respect to the abutment plane 88 through the slit 90.

In operation, each time when a sheet or a set of sheets has been separated and dispensed, the abutment structure 87 is moved back to its starting position against the direction indicated by the arrow 91.

In separating thicker objects, such as sheets of cardboard and booklets with bound edges facing in upstream direction with respect to the displacement direction 91 of the slit 90, it is possible, through adjustment of the distance over which the lead-in edge 115 is staggered with respect to the abutment plane 88 to the thickness of the sheets or sets of sheets to be separated, to provide that each time the slit 90 is displaced along the stack 86 in the direction indicated by an arrow 91, exactly one sheet or one set of sheets is introduced into the slit, without this necessitating separate operation.

Figure 8:
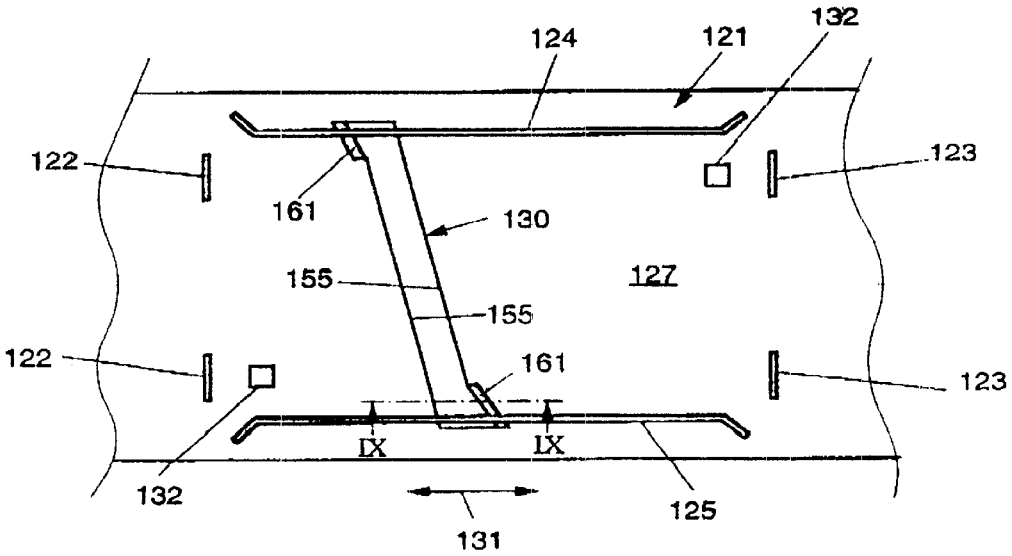
FIG. 8 is a diagrammatic top plan view of an apparatus according to a fourth exemplary embodiment of the invention.
Figure 9:
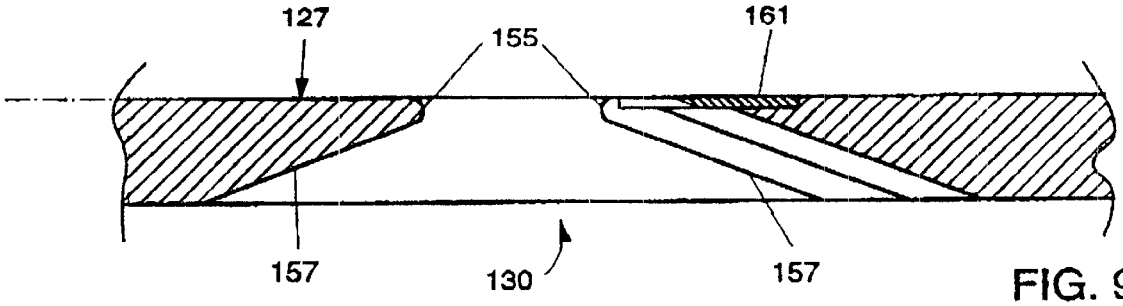
FIG. 9 is a diagrammatic elevation in cross section taken on line IX—IX in FIG. 8.

As in the apparatuses described hereinbefore, in the apparatus according to FIGS. 8 and 9 the holder 121 is made up of a number of guides 122, 123, 124, 125 and an abutment structure 127 with a slit 130. The abutment structure 127 is reciprocable as is indicated by the double arrow 131.

The slit 130 is provided with two lead-in edges 155, so that during both a forward and a backward displacement of the slit a sheet or a set of sheets can be separated. This provides the advantage that no time is lost through an idle backward stroke, so that at a given stroke frequency twice as many sheets or sets of sheets are separated from a stack as would be the case if during the backward stroke no sheet or set of sheets was separated.

Owing to the slit 130 extending obliquely with respect to the displacement path of the slit 130, in each case only a corner portion of a sheet or a set of sheets needs to be brought into the slit before the sheet or the set of sheets can be separated further from the rest of the stack through displacement of the slit 130. Bending a corner portion of a sheet generally requires less force than bending an edge portion of such sheet and can therefore be realized more easily and reliably. The rest of the edge portion is guided into the slit 130 by the lead-in edge and the contiguous guide surface 157 during the beginning of the displacement of the slit 130.

For bringing the corner portions of the documents into the slit 130, the apparatus according to FIGS. 8 and 9 is preferably provided with schematically indicated pickers 132 which more in detail correspond basically to the pickers 12 and 52 according to FIGS. 1–6. These pickers 132 are arranged diametrically opposite each other, under corners of the interior space of the holder 121 defined by the guides 122, 123, 124 and 125. The diagonal defined by the positions of the pickers 132 is rotated with respect to the displacement direction 131 of the slit in a sense opposite to the sense in which the oblique orientation of the slit 130 is rotated with respect to the displacement direction 131 of the slit. As a consequence, before or at the beginning of the displacement of the slit 130 along the stack, a corner portion of the outer sheet of the stack can be pulled into that end of the slit 130, which, viewed in the direction of displacement, is located farthest forward.

The lead-in edges 155 are each provided, in an end area of the slit 130, with an inlaid blade 161, so that those portions of the lead-in edges 155 are razor-sharp. This makes it possible, when separating sheets that are mutually connected approximately parallel to the direction of displacement 131 of the slit 130, to sever these from each other as well.

Owing, moreover, to the slit 130 being reciprocable and the lead-in edges 155 on opposite sides of the slit each being razor-sharp at one end, it is possible to process a stack consisting of zigzag folded web-shaped material into loose, separate sheets by having a trailing edge 155 of the slit 130, when that edge 155 passes between sheets folded against each other, sever and separate those sheets. If the folding edge along which sheets are joined together has priorly been weakened, for instance by means of a perforation, the trailing lead-in edge 155 need not, for the purpose of severing the sheets, have a razor-sharp portion.

The oblique extension of the lead-in edges 155 of the slit, for that matter, is also of advantage when severing sheets along a folding edge. The starting position of the apparatus can then be chosen such that the portion of the relevant lead-in edge acting on a folding edge extends obliquely such that it lags further and further towards the most proximal end of the slit 130. As a result, as sheets to be severed are being severed along the folding edge, an outward force is exerted on that folding edge, which ensures that the sheets do not buckle but are kept smooth and flat.

Figure 11:
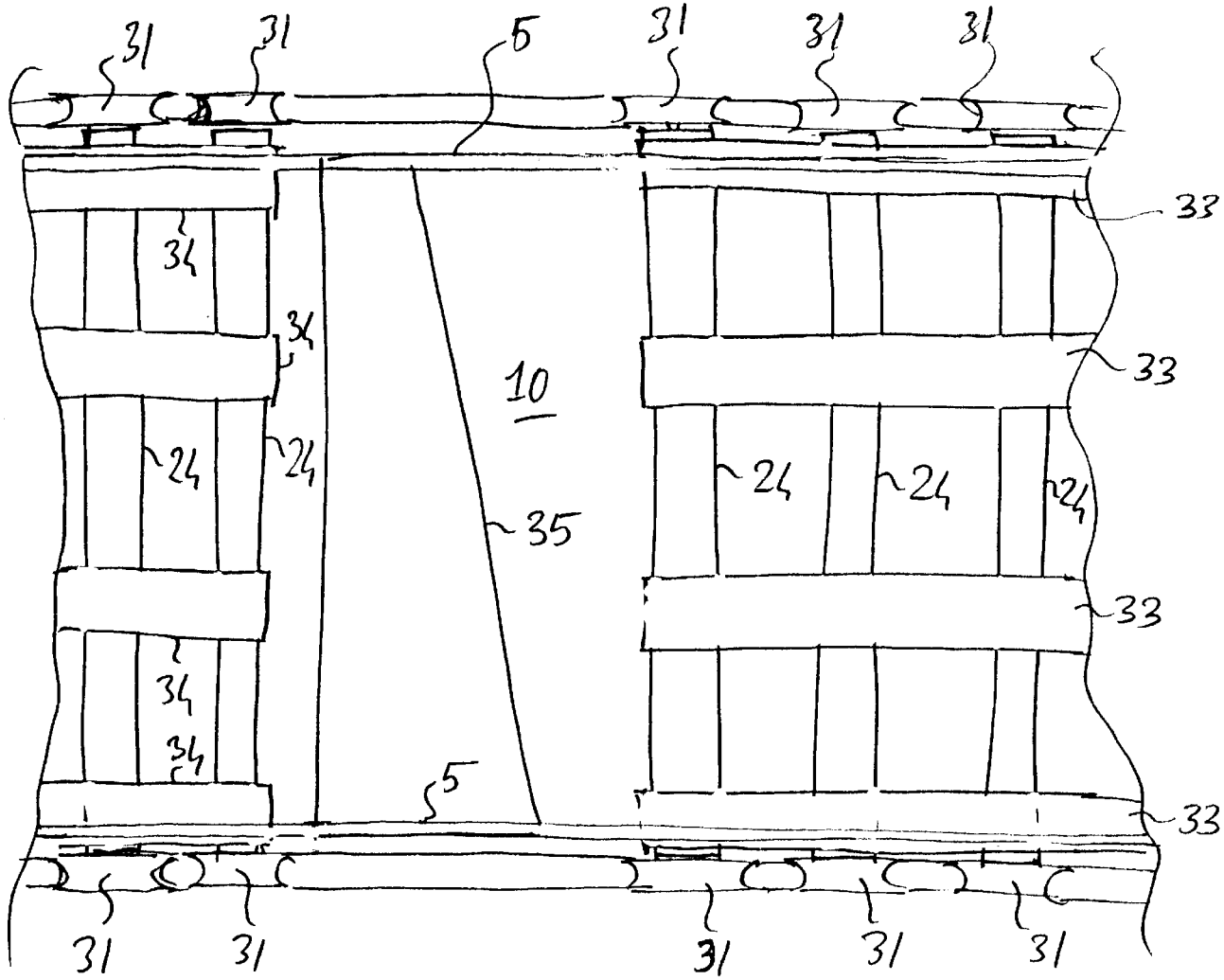
FIG. 11 is a diagrammatic top plan view of an apparatus according to a first exemplary embodiment of the invention.

Thus the apparatus according to FIGS. 8 and 9 is also useful as a burster for severing fanfold forms. For that matter, the apparatuses according to the other embodiments shown are also suitable for use as a burster if the leading edge has a suitable shape and orientation. In the apparatus according to FIGS. 1–5, for the purpose of severing sheets along folding edges, for instance a straight lead-in edge with end portions which, viewed in the direction of displacement 11, extend obliquely rearwards (see FIG. 11), would be preferred most.

Figure 10:
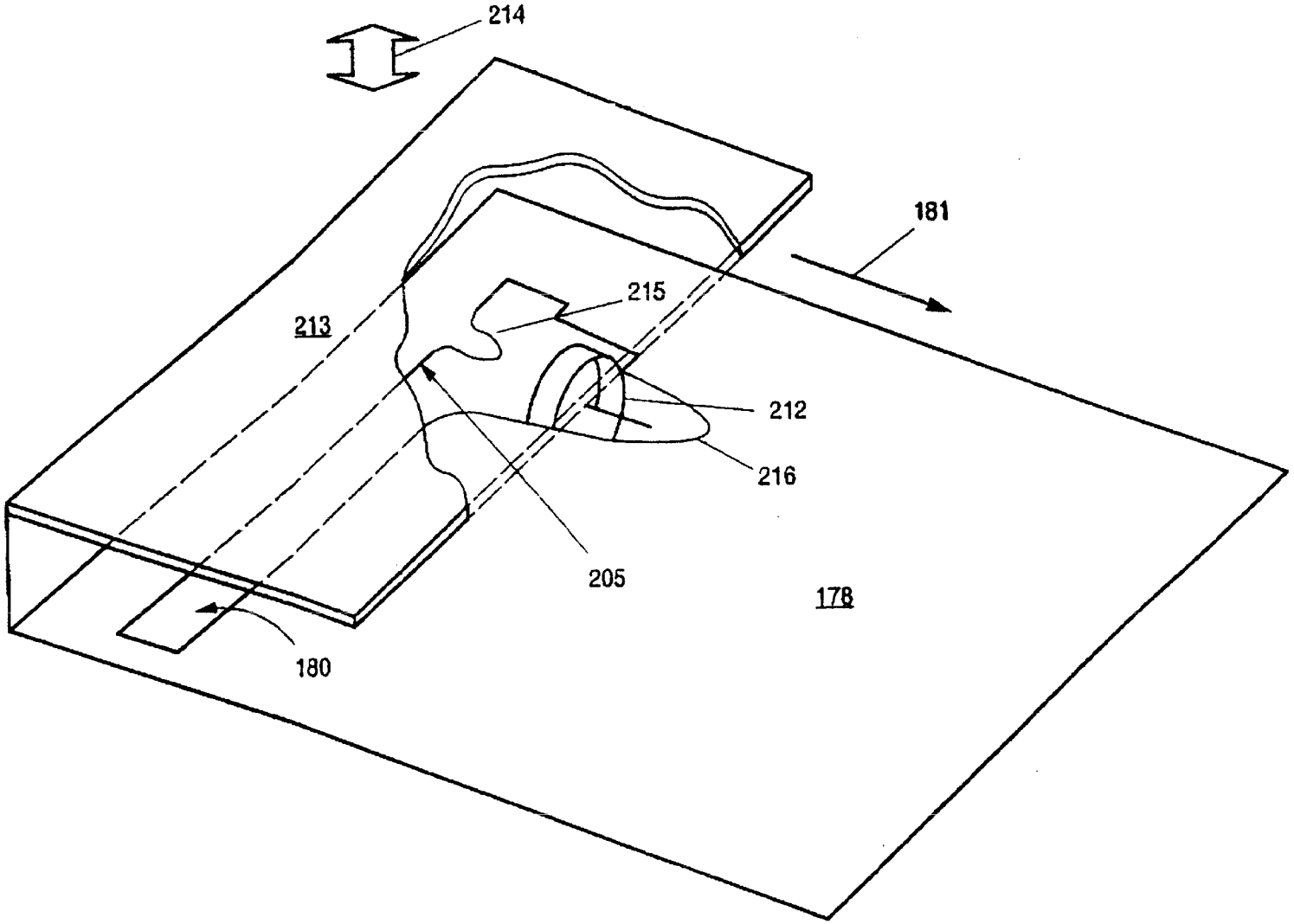
FIG. 10 is a diagrammatic perspective view of a portion of an apparatus according to a fifth exemplary embodiment of the invention.

FIG. 10 diagrammatically represents a further example of an apparatus according to the invention. The rectangle 178 depicted in perspective represents the area of the abutment plane against which in operation the stack of sheets to be processed abuts. The slit 180 is movable relative to the area 178 of the abutment plane in the direction indicated by an arrow 181. Through the slit 180 reaches a roller 212 which has an outer circumference made of a rough material. Arranged above the slit 180 is a pressure plate 213 which is movable relative to the abutment area 178 in a guide (not shown) in the directions indicated by a double arrow 214, which directions typically coincide with the direction in which the sheets to be separated are stacked onto each other. The slit 180 has a lead-in edge 205 which is provided with a projecting tongue 215 straight opposite a recess 216 in the opposite edge of the slit 180.

The introduction of an edge portion of a sheet into the slit 180 is carried out with the apparatus according to FIG. 10 by exerting, by means of the wheel 212, a frictional force on the edge portion of the sheet in question in the direction of the recess. A contiguous edge portion of the outer sheet is then upset in the recess 216. The abutment structure 178 and the pressure plate 213 and sheets, if any, present between the pressure plate 213 and the sheet to be separated prevent the outer sheet from upsetting uncontrollably in a different direction. Then the abutment structure is moved in the direction indicated by the arrow 181, whereby the tongue-shaped portion 215 of the trailing edge 205 of the slit 180 is brought between the upset portion of the edge portion of the outer sheet and next sheets. Then the wheel 212 is retracted from its position wherein it projects through the abutment plane 178 and the abutment structure is moved further in the direction indicated with the arrow 181, whereby contiguous portions of the outer sheet of the stack pass through the slit 181 and are separated from the rest of the stack. Each time a sheet has been separated, the abutment structure can be returned again to the starting position shown in FIG. 10.

Instead of an edge portion, a corner portion of an outer sheet can be upset, whereupon a suitably shaped portion of the trailing edge of the slit can be brought between that sheet and the rest of the stack.

What is claimed is:

1. An apparatus for separating at least one outer sheet from a stack of sheets, said apparatus comprising:

a holder with at least one guide for guiding the stack of sheets with an abutment structure which defines an abutment plane for keeping the stack of sheets in said holder in a position with said at least one outer sheet positioned against the abutment plane, wherein the abutment structure is provided with a slit for allowing at least one sheet to pass therethrough, which slit is movable relative to the at least one guide along the abutment plane along a path with a directional component transverse to said slit for at least partly peeling said at least one outer sheet abutting against the abutment structure from the stack of sheets in the holder;

wherein the abutment structure comprises a plurality of rollers which are rotatably suspended for rolling along a path along said at least one outer sheet of the stack of sheets in the holder, said rollers having axes of rotation oriented perpendicular to said path along said at least one outer sheet of the stack of sheets in the holder; and wherein said slit comprises a lead-in edge along at least one side of the slit, at least a portion of said lead-in edge extending longitudinally in a direction parallel to the abutment plane, and wherein the lead-in edge of said slit is fixed to a first roller of said plurality of rollers, and wherein said abutment structure further comprises at least one flexible pulling element which, on one side of said slit, surrounds at least some of said plurality of rollers, including said first roller, for providing uniform support of said stack of sheets.

2. An apparatus according to claim 1, wherein said at least one outer sheet comprises an outer set of sheets.

3. An apparatus according to claim 1, wherein said at least one flexible pulling element extends from an anchorage operatively fixed with respect to the at least one guide, with the holder and the anchorage being located on a common side of the path along which the rollers are movable.

4. An apparatus according to claim 3, wherein said at least one flexible pulling element forms a loop which passes on a side remote from the abutment plane along the rollers to the anchorage operatively fixed with respect to the at least one guide.

5. An apparatus according to claim 4, wherein said at least one flexible pulling element passes along each of said plurality of rollers on said one side of said slit.

6. An apparatus according to claim 1, wherein the slit is reciprocable and wherein the abutment structure has ends on opposite sides of the holder.

7. An apparatus according to claim 1, wherein said at least one flexible pulling element prevents edge portions of said at least one outer sheet from curling between said plurality of rollers, other than through said slit.

8. An apparatus according to claim 1, wherein said lead-in edge extends obliquely to the path along which the slit is movable, and obliquely to said rollers.

* * * * *